US010463073B1

(12) United States Patent
Tang et al.

(10) Patent No.: US 10,463,073 B1
(45) Date of Patent: Nov. 5, 2019

(54) SLIDING COVER-OPENING DEVICE

(71) Applicant: CHINA TOBACCO YUNNAN INDUSTRIAL CO., LTD, Kunming (CN)

(72) Inventors: Jianguo Tang, Kunming (CN); Xudong Zheng, Kunming (CN); Xu Zeng, Kunming (CN); Ru Wang, Kunming (CN); Chengya Wang, Kunming (CN); Shanzhai Shang, Kunming (CN); Ping Lei, Kunming (CN); Jingmei Han, Kunming (CN); Zhiqiang Li, Kunming (CN); Dalin Yuan, Kunming (CN); Changshan Zhao, Kunming (CN); Shiwei Li, Kunming (CN); Yongkuan Chen, Kunming (CN); Hongyong Luo, Kunming (CN); Fengren Fang, Kunming (CN)

(73) Assignee: CHINA TOBACCO YUNNAN INDUSTRIAL CO., LTD, Kunming (CN)

( * ) Notice: Subject to any disclaimer, the term of this patent is extended or adjusted under 35 U.S.C. 154(b) by 0 days.

(21) Appl. No.: 16/337,414

(22) PCT Filed: Oct. 17, 2017

(86) PCT No.: PCT/CN2017/106530

§ 371 (c)(1),
(2) Date: Mar. 28, 2019

(87) PCT Pub. No.: WO2018/072680

PCT Pub. Date: Apr. 26, 2018

(30) Foreign Application Priority Data

Oct. 18, 2016 (CN) ..... 2016 1 0905641

(51) Int. Cl.
*A24F 15/00* (2006.01)
*A24F 15/12* (2006.01)
*A24F 47/00* (2006.01)

(52) U.S. Cl.
CPC ..... *A24F 15/12* (2013.01); *A24F 47/008* (2013.01)

(58) Field of Classification Search
CPC ..... A24F 15/12; A24F 47/008; A24F 15/00; A24F 15/20; A24F 15/14
(Continued)

(56) References Cited

U.S. PATENT DOCUMENTS 2,531,737 A * 11/1950 Lyon, Jr. ..... A24F 15/12 220/345.3
3,722,742 A * 3/1973 Wertz ..... A24F 15/005 221/15

(Continued)

FOREIGN PATENT DOCUMENTS

CN 200999132 Y 1/2008
CN 105246360 A 1/2016

(Continued)

*Primary Examiner* — Ernesto A Grano
(74) *Attorney, Agent, or Firm* — Gokalp Bayramoglu

(57) ABSTRACT

A sliding cover-opening device includes a top support, a sliding-resistant device, and a rotatable cover opening device. The rotatable cover opening device further includes a rotatable pushing cover and a rotating torsional spring. According to the sliding cover-opening device, the rotatable pushing cover can automatically rotate to 90 degrees to open completely after sliding over a certain distance. Also, with the sliding-resistant device, users can experience a sliding feeling by hands.

5 Claims, 6 Drawing Sheets

(58) Field of Classification Search
USPC ..... 206/364, 252
See application file for complete search history.

(56) References Cited

U.S. PATENT DOCUMENTS

| | | | | |
|---|---|---|---|---|
| 3,960,270 | A * | 6/1976 | May | B65D 25/04 206/256 |
| D723,738 | S * | 3/2015 | Liu | D27/189 |
| 10,306,921 | B2 * | 6/2019 | Hermans | A24F 23/04 |
| 2008/0223382 | A1 * | 9/2008 | Zeanah | A24F 19/14 131/235.1 |
| 2011/0180433 | A1 * | 7/2011 | Rennecamp | A24F 9/16 206/268 |
| 2013/0037042 | A1 * | 2/2013 | Hearn | A24F 47/002 131/329 |
| 2014/0020697 | A1 * | 1/2014 | Liu | A24F 15/00 131/329 |
| 2014/0216961 | A1 * | 8/2014 | Liu | A24F 15/12 206/266 |
| 2014/0299492 | A1 * | 10/2014 | Liu | A24F 15/12 206/264 |
| 2015/0101944 | A1 * | 4/2015 | Li | A24F 15/18 206/267 |
| 2015/0101945 | A1 * | 4/2015 | Scatterday | A24F 13/14 206/268 |
| 2015/0245654 | A1 * | 9/2015 | Memari | A24F 15/12 141/2 |
| 2016/0101909 | A1 * | 4/2016 | Schennum | A45C 13/007 206/266 |
| 2016/0120218 | A1 * | 5/2016 | Schennum | A24F 15/12 206/266 |
| 2017/0043910 | A1 * | 2/2017 | Hopps | A24F 47/008 |
| 2017/0099877 | A1 * | 4/2017 | Worm | A61M 11/042 |
| 2017/0099878 | A1 * | 4/2017 | Murison | H02J 7/0044 |
| 2017/0150757 | A1 * | 6/2017 | Worm | A24F 47/008 |
| 2017/0181471 | A1 * | 6/2017 | Phillips | H02J 7/0029 |
| 2017/0208862 | A1 * | 7/2017 | Li | A24F 15/20 |
| 2017/0327291 | A1 * | 11/2017 | Senftleben | A24F 9/16 |
| 2017/0341829 | A1 * | 11/2017 | Rehders | A24F 15/12 |
| 2019/0082734 | A1 * | 3/2019 | Alarcon | A24F 15/12 |
| 2019/0100360 | A1 * | 4/2019 | Ziering | B65D 43/22 |

FOREIGN PATENT DOCUMENTS

| | | | |
|---|---|---|---|
| CN | 205082660 | U | 3/2016 |
| CN | 106509991 | A | 3/2017 |
| CN | 206165807 | U | 5/2017 |
| JP | 2009154568 | A | 7/2009 |
| JP | 2013116752 | A | 6/2013 |

* cited by examiner

SLIDING COVER-OPENING DEVICE

CROSS REFERENCE TO THE RELATED APPLICATIONS

This application is the national phase entry of International Application No. PCT/CN2017/106530, filed on Oct. 17, 2017, which is based upon and claims priority to Chinese Patent Application No. 201610905641.0, filed on Oct. 18, 2016, the entire contents of which are incorporated herein by reference.

TECHNICAL FIELD

The present invention belongs to the field of electronic cigarette, specifically relates to a sliding cover-opening device.

BACKGROUND

The existing cover opening device for cigarette case is composed of a button switch and a rotating device. The cover opening device available now mainly includes the following components: a rotating spring, a cigarette case main body, a cigarette case cover, and a button switch. For cover closing, the cigarette case cover is locked by the button switch to tightly compress the rotating spring of the cigarette case main body, so the rotating spring is in a compression state. For cover opening, the button switch is pressed by an external force, so the cigarette case cover is not limited by the button switch anymore, and a rotating torsion spring drives the cigarette case cover to rotate until a free opening state.

SUMMARY

Based on the existing cover opening device with button switch, the present invention develops a sliding cover-opening device, including:

a top support 3 located on an upper portion of a main body of a cigarette case 8, wherein an overall structure of the top support is a hollow frame having walls for fixing other elements and holes for other elements to extend out; two side walls opposite to each other are provided with a pair of sliding grooves 302, one of the two side walls is provided with a cigarette case snap-fit hole 10, and the other one of the two side walls is fixedly connected to a spring fixing plate 301 on the cigarette case 8;

a sliding-resistant device located inside the hollow frame of the top support 3, wherein the sliding-resistant device includes a cylindrical spring cap 5, a spring threaded seat 6 located on a lower portion of the cylindrical spring cap 5 and fixedly connected to the cylindrical spring cap 5, a cover pushing spring 1 located inside the cylindrical spring cap 5, and a hemispherical spring head 4 located on an upper portion of the cylindrical spring cap 5 and connected to the cover pushing spring 1;

a rotatable cover opening device, wherein the rotatable cover opening device includes a rotatable pushing cover 7, one segment of the rotatable pushing cover is in a form of a cover for covering at least a part of an upper surface of the top support 3, and an end of the segment is provided with a snap-fit block 72 matched with the cigarette case snap-fit hole 10; another segment of the rotatable pushing cover is a pair of symmetrically separated blocks, each of the separated blocks is provided with a sliding rotating groove 701, a connection part of the two segments is a cylinder body, two ends of the cylinder body are respectively provided with a rotating locating pin 702, the rotating locating pin 702 is arranged inside the sliding groove 302 and capable of rotating freely and moving horizontally; the rotatable cover opening device further includes a rotating torsional spring 2, a main body of the torsional spring is wound on a cylinder body of a fixed support 9, one end of the rotating torsional spring 2 is fixedly connected inside the sliding rotating groove 701, and the other end of the rotating torsional spring is fixed by the spring fixing plate 301 on the cigarette case 8.

Preferably, a lower portion of the spring head 4 extends into the cylindrical spring cap 5, and an inner protrusion edge at an upper portion of the cylindrical spring cap 5 is matched with an outer protrusion edge located at the lower portion of the spring head 4.

Preferably, an upper surface of the rotatable pushing cover 7 is a rough surface.

Preferably, a cylinder body of the rotatable pushing cover 7 is in a close contact with the hemispherical spring head 4.

Preferably, the fixed support 9 is connected to the spring threaded seat 6 through threads, and the fixed support 9 is connected to a lower surface of an upper layer of the top support 3 through threads.

The working principle of the sliding cover-opening device of the present invention is as follows.

The cover pushing spring 1 in a free state is put into the spring cap 5, the hemispherical spring head 4 is fitted into the spring cap 5, the inner protrusion edge at the upper portion of the spring cap 5 is matched with the outer protrusion edge at the lower portion of the spring head 4, and the spring head 4 is tightly compressed by the cover pushing spring 1 in the free state. The spring cap 5 is fixedly connected to the spring threaded seat 6 through press riveting, and the spring threaded seat 6 is connected to the fixed support 9 through the threads. The fixed support 9 is connected to the top support 3 through the threads. The top support 3 is connected to the spring fixing plate 301 on the cigarette case 8 through the threads. The rotatable pushing cover 7 is locked by the spring head 4 and the top support 3 in a closed state. In this case, the rotating locating pin 702 on the rotatable pushing cover 7 is located in the sliding groove 302, the cylinder body of the rotatable pushing cover 7 is in a close contact with the hemispherical spring head 4, and the cover pushing spring 1 inside the spring cap 5 is in a free opening state, as shown in FIG. 1 or FIG. 2. By manually pushing the top rough layer of the rotatable pushing cover 7 or directly pushing the rotating locating pin 702, the rotating locating pin 702 slides horizontally along the sliding groove 302, meanwhile, the rotating torsional spring 2 is pulled to generate a resilience force. When the rotatable pushing cover 7 slides to the highest point of the spring head 4, the cover pushing spring 1 is in a compression state, and the elastic force is maximum, as shown in FIG. 3. When the rotatable pushing cover 7 slides over the highest point of the spring head 4, the cover pushing spring 1 is in a free opening state, at this time, the snap-fit block 72 is separated from the cigarette case snap-fit hole 10, as shown in FIG. 4 or FIG. 5. In this case, the rotating torsional spring 2 is in the compression state and has a maximum elastic force. Since the snap-fit block 72 is separated from the cigarette case snap-fit hole 10, the rotating torsional spring 2 drives the rotatable pushing cover 7 to rotate, the maximum rotation angle can reach 90 degrees, and the rotatable pushing cover 7 reaches a free opening state, as shown in FIG. 6 or FIG. 7.

ADVANTAGES OF THE PRESENT INVENTION

1. According to the sliding cover-opening device of the present invention, the rotatable pushing cover 7 can automatically rotate to 90 degrees to open completely after sliding over a certain distance.

2. The sliding cover-opening device of the present invention is more durable. With the sliding-resistant device, users can experience a sliding feeling by hands.

Figure 1:
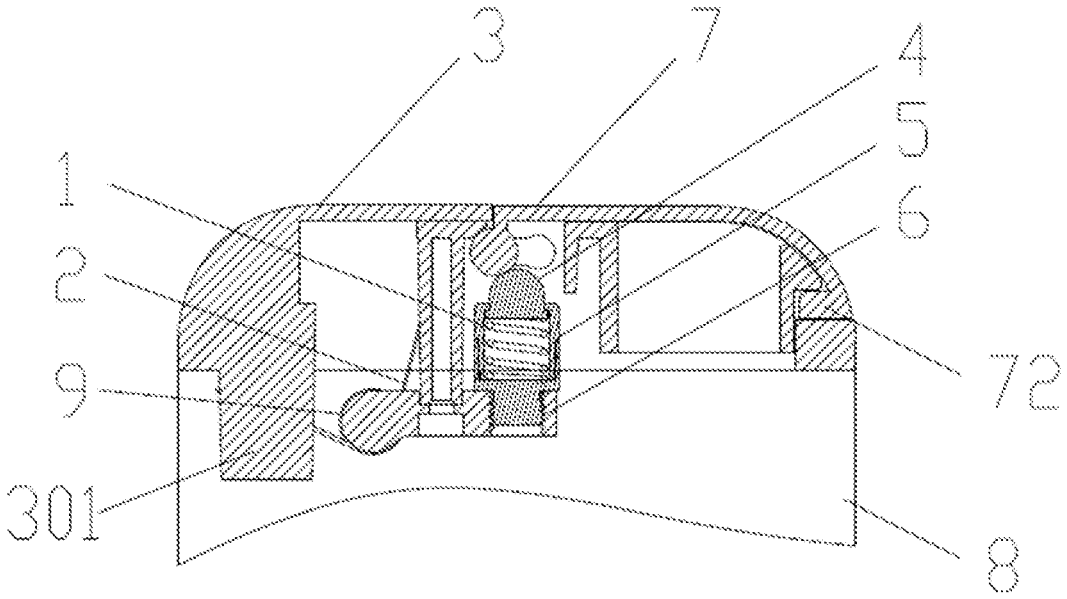
FIG. 1 and FIG. 2 are schematic diagrams showing a closed state of a rotatable pushing cover 7 of a sliding cover-opening device of the present invention.

In the drawings, 1—cover pushing spring; 2—rotating torsional spring; 3—top support; 4—spring head; 5—spring cap; 6—spring threaded seat; 7—rotatable pushing cover; 8—cigarette case; 9—fixed support; 10—cigarette case snap-fit hole; 72—snap-fit block; 301—spring fixing plate; 302—sliding groove; 701—sliding rotating groove; 702—rotating locating pin.

DETAILED DESCRIPTION OF THE EMBODIMENTS

Figure 2:
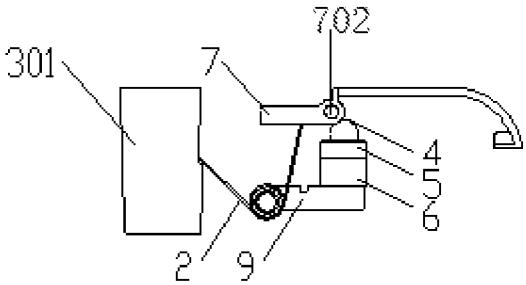
Figure 11:
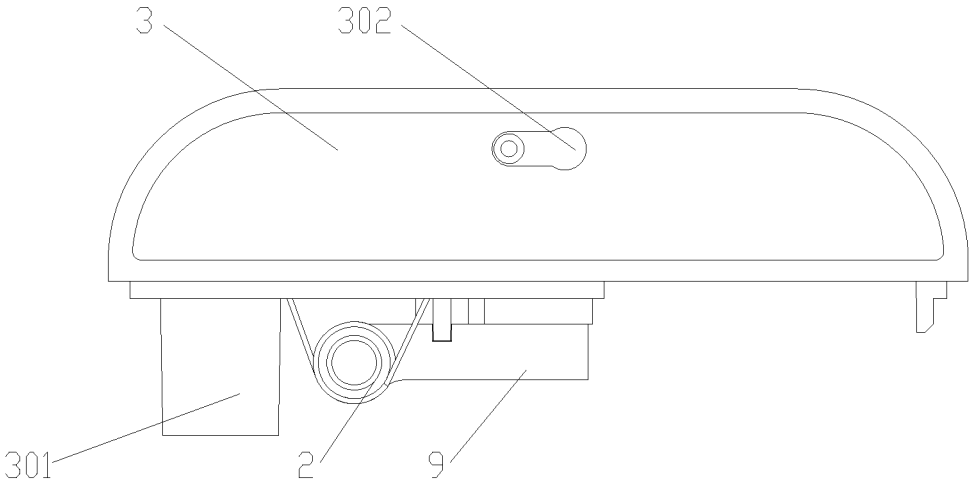
FIG. 11 is a front view of an overall upper portion of a sliding cover-opening device of the present invention (in a closed state)

The rotatable pushing cover 7 is locked by the spring head 4 and the top support 3 and is in a closed state. At this time, the cylinder body of the rotatable pushing cover 7 is in a close contact with the hemispherical spring head 4, and the cover pushing spring 1 in the spring cap 5 is in a free opening state, as shown in FIG. 1 or FIG. 2 and FIG. 11.

Figure 3:
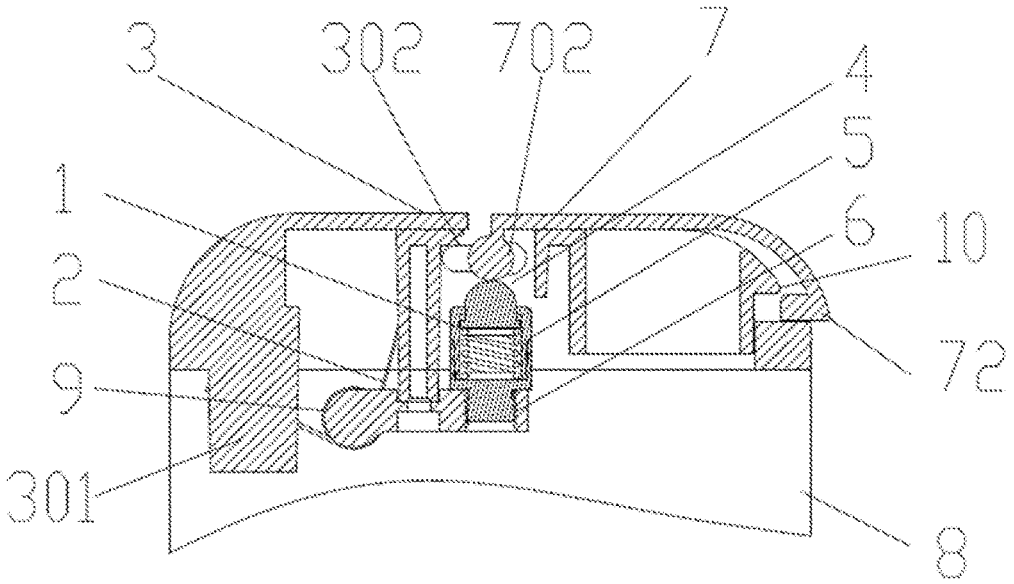
FIG. 3 is a schematic diagram showing a state when a rotatable pushing cover 7 of a sliding cover-opening device of the present invention slides to a highest point of a spring head 4.

Since the upper surface of the rotatable pushing cover 7 is a rough surface, through manually pushing the rotatable pushing cover 7 in a horizontal direction, the rotatable pushing cover 7 slides horizontally along the horizontal sliding groove 11. Meanwhile, the rotating torsional spring 2 is pulled to generate a resilience force. When the rotatable pushing cover 7 slides to the highest point of the spring head 4, the cover pushing spring 1 is in a compression state, and the elastic force is maximum, as shown in FIG. 3.

Figure 4:
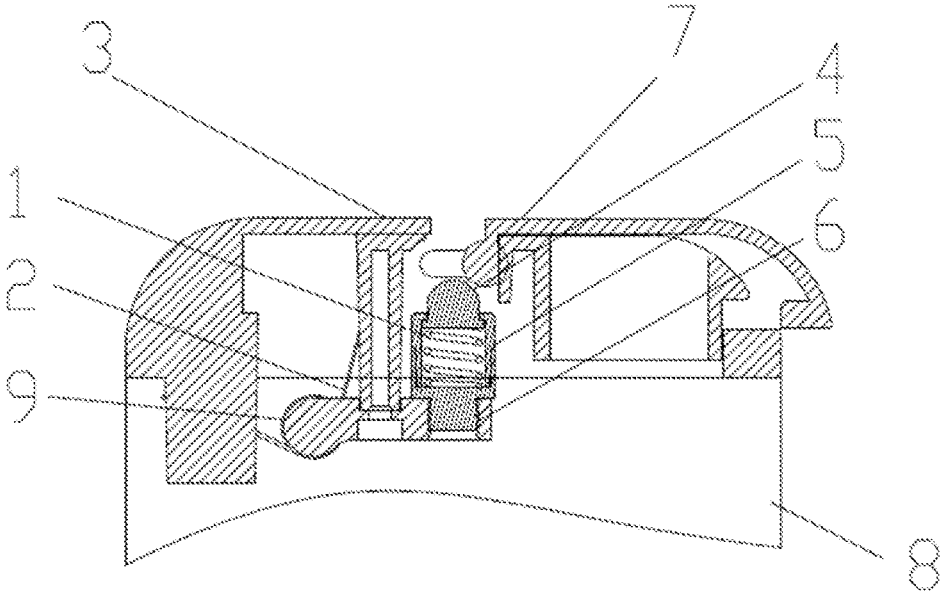
FIG. 4 and FIG. 5 are schematic diagrams showing a state when a snap-fit block 72 of a rotatable pushing cover 7 of a sliding cover-opening device of the present invention is separated from a cigarette case snap-fit hole 10.
Figure 5:
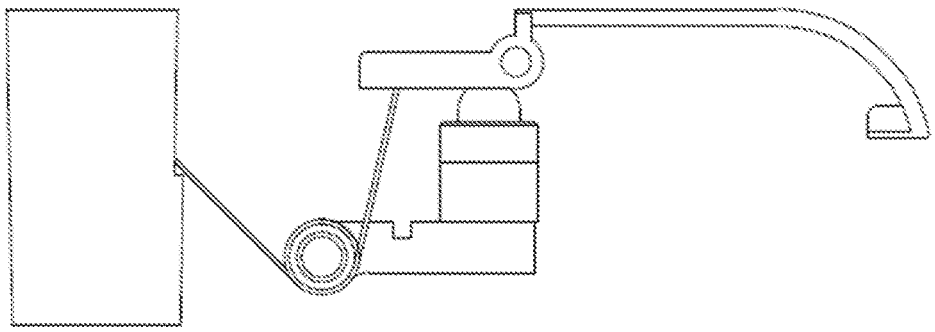
Figure 6:
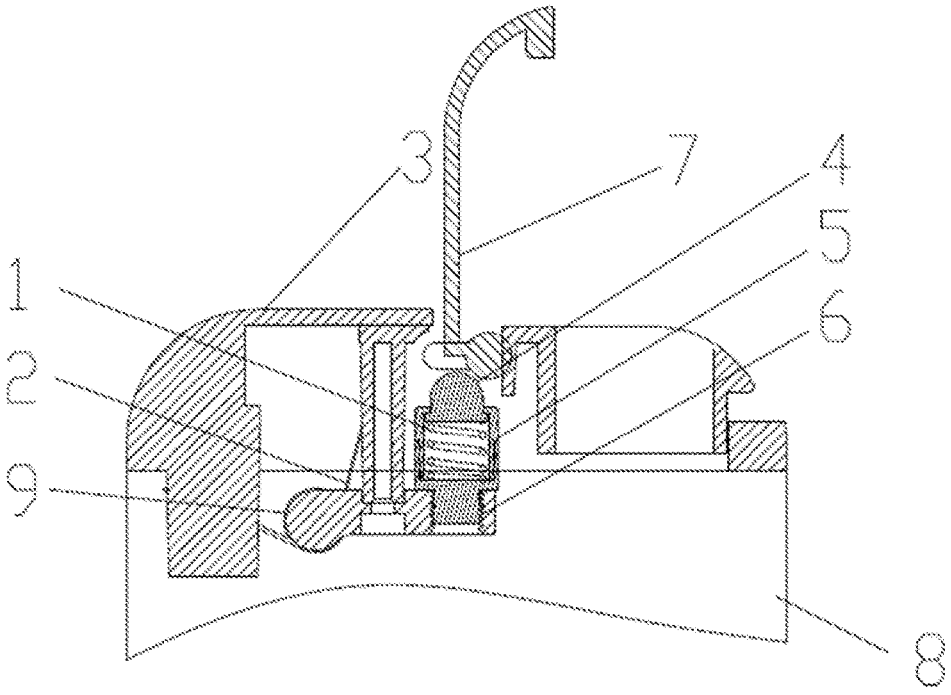
FIG. 6 and FIG. 7 are schematic diagrams showing a rotatable pushing cover 7 of a sliding cover-opening device of the present invention being in a free opening state and rotated to 90 degrees.
Figure 7:
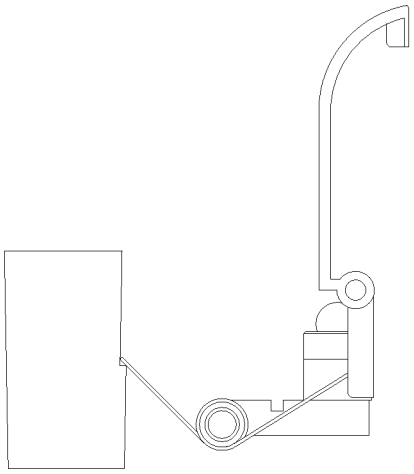
Figure 8:
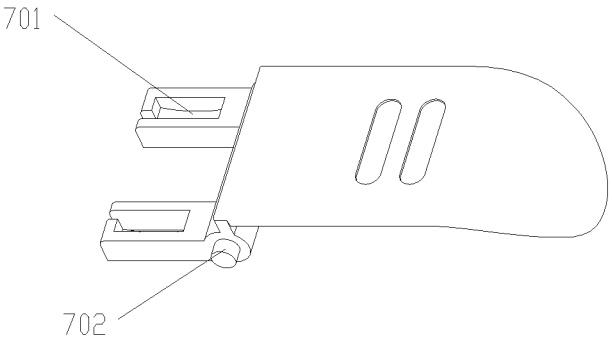
FIG. 8 and FIG. 9 are perspective views of a rotatable pushing cover 7 of a sliding cover-opening device of the present invention.
Figure 9:
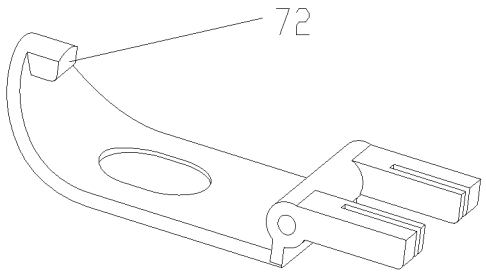
Figure 10:
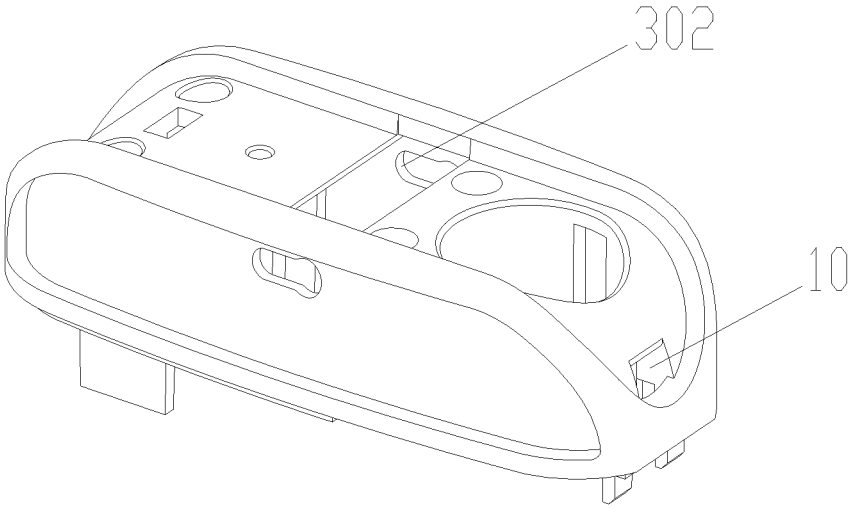
FIG. 10 is a perspective view of a top support 3 of a sliding cover-opening device of the present invention.
Figure 12:
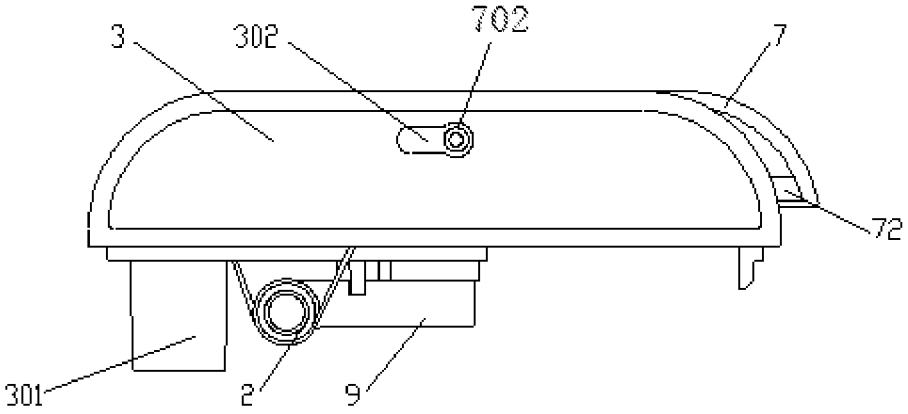
FIG. 12 is a front view of an overall upper portion of a sliding cover-opening device of the present invention (in a state when a snap-fit block 72 is separated from a cigarette case snap-fit hole 10).

When the rotatable pushing cover 7 slides over the highest point of the spring head 4, the snap-fit block 72 is separated from the cigarette case snap-fit hole 10 at this time, as shown in FIG. 4 or FIG. 5 and FIG. 12. In this case, the rotating torsional spring 2 is in a tension state, and the resilience force is maximum. Since the snap-fit block 72 is separated from the cigarette case snap-fit hole 10, the rotating torsional spring 2 drives the rotatable pushing cover 7 to rotate, the maximum rotation angle can reach 90 degrees, and the rotatable pushing cover 7 reaches a free opening state, as shown in FIG. 6 or FIG. 7.

The steps of closing the rotatable pushing cover 7 are as follows. The rotatable pushing cover 7 is pressed down manually. Since the upper surface of the rotatable pushing cover 7 is a rough surface, the rotatable pushing cover 7 is driven to slide reversely and horizontally, to make the snap-fit block 72 engaged with the cigarette case snap-fit hole 10, and thus closing the rotatable pushing cover 7 to present a closed state.

What is claimed is:

1. A sliding cover-opening device, comprising:

a top support located on an upper portion of a main body of a cigarette case, wherein an overall structure of the top support is a hollow frame having a plurality of walls for fixing other elements and a plurality of holes for other elements to extend out; two side walls of the top support opposite to each other are provided with a pair of sliding grooves, one of the two side walls is provided with a cigarette case snap-fit hole, and the other one of the two side walls is fixedly connected to a spring fixing plate on the cigarette case;

a sliding-resistant device located inside the hollow frame of the top support, wherein the sliding-resistant device comprises a cylindrical spring cap, a spring threaded seat located on a lower portion of the cylindrical spring cap and fixedly connected to the cylindrical spring cap, a cover pushing spring located inside the cylindrical spring cap, and a spring head located on an upper portion of the cylindrical spring cap and connected to the cover pushing spring;

a rotatable cover opening device, wherein the rotatable cover opening device comprises a rotatable pushing cover, a first segment of the rotatable pushing cover is in a form of cover for covering at least a part of an upper surface of the top support, and an end of the first segment is provided with a snap-fit block matched with the cigarette case snap-fit hole; a second segment of the rotatable pushing cover is a pair of symmetrically separated blocks, each of the separated blocks is provided with a sliding rotating groove, a connection part of the first segment and the second segment is a cylinder body, two ends of the cylinder body are respectively provided with a rotating locating pin, the rotating locating pin is arranged inside one of the sliding grooves, and the locating pin rotates freely and moves horizontally; the rotatable cover opening device further comprises a rotating torsional spring, a main body of the rotating torsional spring is wound on a cylinder body of a fixed support, one end of the rotating torsional spring is fixedly connected inside the sliding rotating groove, and the other end of the rotating torsional spring is fixed by the spring fixing plate.

2. The sliding cover-opening device of claim 1, wherein a lower portion of the spring head extends into the cylindrical spring cap, and an inner protrusion edge at the upper portion of the cylindrical spring cap is matched with an outer protrusion edge at the lower portion of the spring head.

3. The sliding cover-opening device of claim 1, wherein an upper surface of the rotatable pushing cover is a rough surface.

4. The sliding cover-opening device of claim 1, wherein a cylinder body of the rotatable pushing cover is in a close contact with the spring head.

5. The sliding cover-opening device of claim 1, wherein the fixed support is connected to the spring threaded seat through a first thread, and the fixed support is connected to a lower surface of an upper layer of the top support through a second thread.

* * * * *